US007704379B2

(12) United States Patent
Jiang et al.

(10) Patent No.: US 7,704,379 B2
(45) Date of Patent: Apr. 27, 2010

(54) DUAL CATALYST SYSTEM FOR HYDROISOMERIZATION OF FISCHER-TROPSCH WAX AND WAXY RAFFINATE

(75) Inventors: Zhaozhong Jiang, Somerville, NJ (US); Terry Eugene Helton, Bethlehem, PA (US); Randall David Partridge, Califon, NJ (US); Larry E. Hoglen, Mickleton, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 687 days.

(21) Appl. No.: 10/266,369

(22) Filed: Oct. 8, 2002

(65) Prior Publication Data

US 2004/0065581 A1 Apr. 8, 2004

(51) Int. Cl.
*C10G 65/18* (2006.01)
*C10G 47/02* (2006.01)

(52) U.S. Cl. ..... 208/111.35; 208/59; 208/134; 208/950; 208/137; 208/61

(58) Field of Classification Search ..... 208/28, 208/111.35, 134, 950, 137; 585/734, 735, 585/737

See application file for complete search history.

(56) References Cited

U.S. PATENT DOCUMENTS

| | | | | |
|---|---|---|---|---|
| 2,250,410 | A | 7/1941 | Van Peski | 260/676 |
| 3,711,399 | A | 1/1973 | Estes | 208/112 |
| 4,097,364 | A | 6/1978 | Egan | 208/111 |
| 4,181,597 | A | 1/1980 | Yan et al. | 208/46 |
| 4,335,019 | A | 6/1982 | Bowes et al. | 252/450 |
| 4,377,469 | A | 3/1983 | Shihabi | 208/111 |
| 4,388,177 | A | 6/1983 | Bowes et al. | 208/111 |
| 4,402,866 | A | 9/1983 | Shihabi | 252/455 |
| 4,431,516 | A | 2/1984 | Baird et al. | 208/111 |
| 4,431,517 | A | 2/1984 | Nevitt et al. | 208/111 |
| 4,431,519 | A | 2/1984 | LaPierre et al. | 208/111 |
| 4,431,527 | A | 2/1984 | Miller et al. | 208/254 |
| 4,436,614 | A | 3/1984 | Olbrich et al. | 208/89 |
| 4,460,698 | A | 7/1984 | Hensley, Jr. et al. | 502/66 |
| 4,483,764 | A | 11/1984 | Hensley, Jr. et al. | 208/111 |
| 4,490,242 | A | 12/1984 | Oleck et al. | 208/97 |
| 4,510,045 | A | 4/1985 | Dessau | 208/111 |
| 4,568,449 | A | 2/1986 | Angmorter et al. | 208/215 |
| 4,594,146 | A | 6/1986 | Chester et al. | 208/111 |
| 4,599,162 | A | 7/1986 | Yen | 208/59 |
| 4,601,993 | A | 7/1986 | Chu et al. | 502/66 |
| 4,610,778 | A | 9/1986 | Graven | 208/89 |
| 4,622,130 | A | 11/1986 | Stem | 208/87 |
| 4,636,299 | A | 1/1987 | Unmuth et al. | 208/87 |

(Continued)

FOREIGN PATENT DOCUMENTS

| | | |
|---|---|---|
| EP | 0140468 | 5/1985 |

(Continued)

*Primary Examiner*—Tam M Nguyen

(57) ABSTRACT

The present invention relates to a process for converting Fischer-Tropsch wax to high quality lube basestocks using a molecular sieve Beta catalyst followed by a unidimensional intermediate pore molecular sieve with near circular pore structures having an average diameter of 0.50 nm to 0.65 nm wherein the difference between the maximum diameter and the minimum is ≦0.05 nm. Both catalysts comprise one or more Group VIII metals. For example, a cascaded two-bed catalyst system consisting of a first bed Pt/Beta catalyst followed by a second bed Pt/ZSM-48 catalyst is highly selective for wax isomerization and lube hydrodewaxing with minimal gas formation.

8 Claims, 7 Drawing Sheets

U.S. PATENT DOCUMENTS

| | | | | |
|---|---|---|---|---|
| 4,684,756 | A | 8/1987 | Derr, Jr. et al. | 585/330 |
| 4,767,522 | A | 8/1988 | Yen | 208/111 |
| 4,784,747 | A | 11/1988 | Shihabi | 208/111 |
| 4,810,357 | A | 3/1989 | Chester et al. | 208/78 |
| 4,911,821 | A | 3/1990 | Katzer et al. | 208/27 |
| 4,919,788 | A | 4/1990 | Chen et al. | 208/59 |
| 4,975,177 | A | 12/1990 | Garwood et al. | 208/27 |
| 5,017,535 | A | 5/1991 | Schoonhoven et al. | 502/30 |
| 5,037,528 | A | 8/1991 | Garwood et al. | 208/27 |
| 5,059,299 | A | 10/1991 | Cody et al. | 208/27 |
| 5,075,269 | A | 12/1991 | Degnan et al. | 502/77 |
| 5,135,638 | A | 8/1992 | Miller | 208/27 |
| 5,146,022 | A | 9/1992 | Buchanan et al. | 585/12 |
| 5,208,403 | A | 5/1993 | Buchanan et al. | 585/7 |
| 5,232,579 | A | 8/1993 | Absil et al. | 208/113 |
| 5,246,566 | A | 9/1993 | Miller | 208/27 |
| 5,275,719 | A | 1/1994 | Baker, Jr. et al. | 208/58 |
| 5,276,229 | A | 1/1994 | Buchanan et al. | 585/255 |
| 5,288,395 | A | 2/1994 | Marler et al. | 208/58 |
| 5,358,628 | A | 10/1994 | Apelian et al. | 208/60 |
| 5,498,821 | A | 3/1996 | Ryan et al. | 585/750 |
| 5,516,736 | A | 5/1996 | Chang et al. | 502/64 |
| 5,643,440 | A | 7/1997 | Borghard et al. | 208/58 |
| 5,689,031 | A | 11/1997 | Berlowitz et al. | 585/734 |
| 5,730,858 | A | 3/1998 | Olivier et al. | 208/28 |
| 5,911,874 | A | 6/1999 | Cody et al. | 208/87 |
| 5,935,417 | A | 8/1999 | Cody et al. | 208/87 |
| 5,951,848 | A | 9/1999 | Baker, Jr. et al. | 208/28 |
| 5,976,351 | A | 11/1999 | Apelian et al. | 208/27 |
| 5,993,644 | A | 11/1999 | Xiao et al. | 208/89 |
| 6,013,171 | A | 1/2000 | Cook et al. | 208/27 |
| 6,051,129 | A | 4/2000 | Harris et al. | 208/138 |
| 6,080,301 | A | 6/2000 | Berlowitz et al. | 208/18 |
| 6,090,989 | A | 7/2000 | Trewella et al. | 585/13 |
| 6,096,189 | A | 8/2000 | Cody et al. | 208/87 |
| 6,099,719 | A | 8/2000 | Cody et al. | 208/87 |
| 6,103,101 | A | 8/2000 | Fragelli et al. | 208/89 |
| 6,136,181 | A | 10/2000 | Ziemer | 208/144 |
| 6,179,994 | B1 | 1/2001 | Clark et al. | 208/27 |
| 6,190,532 | B1 | 2/2001 | Degnan et al. | 208/27 |
| 6,231,749 | B1 | 5/2001 | Degnan et al. | 208/27 |
| 6,264,826 | B1 | 7/2001 | Xiao et al. | 208/18 |
| 6,294,077 | B1 | 9/2001 | Dougherty et al. | 208/27 |
| 6,310,265 | B1 | 10/2001 | Chester et al. | 585/739 |
| 6,322,692 | B1 | 11/2001 | Cody et al. | 208/18 |
| 6,337,010 | B1 | 1/2002 | Hofer | 208/58 |
| 6,420,618 | B1 | 7/2002 | Berlowitz et al. | 585/310 |
| 6,652,735 | B2 | 11/2003 | Degnan et al. | 208/27 |
| 6,663,768 | B1 | 12/2003 | Miller | 208/27 |
| 2001/0004972 | A1 | 6/2001 | Miller et al. | 208/18 |
| 2001/0006154 | A1 | 7/2001 | Krug et al. | 208/18 |
| 2002/0003102 | A1 | 1/2002 | O'Rear et al. | 208/18 |
| 2002/0192156 | A1 | 12/2002 | Rouleau et al. | |
| 2003/0168379 | A1 | 9/2003 | Degnan et al. | 208/27 |

FOREIGN PATENT DOCUMENTS

| | | | |
|---|---|---|---|
| EP | 0225053 | * | 6/1987 |
| EP | 0147873 | | 3/1988 |
| EP | 0 324 528 | | 6/1991 |
| EP | 0635557 | | 1/1995 |
| EP | 0707057 | | 4/1996 |
| EP | 0776959 | | 6/1997 |
| EP | 0909304 | | 9/2001 |
| EP | 0 776 959 | | 10/2004 |
| FR | 2805543 | | 2/2000 |
| FR | 2805542 | | 8/2001 |
| GB | 772478 | | 4/1957 |
| GB | 1582789 | | 1/1981 |
| GB | 2109402 | | 6/1983 |
| GB | 2311789 | | 10/1997 |
| SU | 1696391 | | 12/1991 |
| WO | WO 96/07715 | | 3/1996 |
| WO | WO 97/18278 | | 5/1997 |
| WO | WO 99/20720 | | 4/1999 |
| WO | WO 99/41336 | | 8/1999 |
| WO | WO 01/07538 | | 2/2001 |
| WO | WO 01/18156 | | 3/2001 |
| WO | WO 01/64339 | | 9/2001 |
| WO | WO 02/48283 | | 6/2002 |
| WO | WO 02/48291 | | 6/2002 |
| WO | WO 02/88279 | | 11/2002 |
| WO | WO 02/99014 | | 12/2002 |

* cited by examiner

Product Yields for Hydroisomerization of Sasol C80 F-T Wax over Pt/Beta Followed by Pt/ZSM-48

Comparison of Lube Yields vs. Processing Severity
(Conditions: 1000 psig, 1.0 $h^{-1}$ LHSV for Each Catalyst)

Lube Viscosity vs. Hydroprocessing Severity
(Conditions: 1000 psig, 1.0 $h^{-1}$ LHSV for Each Catalyst)

Lube Viscosity Index vs. Hydroprocessing Severity (Conditions: 1000 psig, 1.0 $h^{-1}$ LHSV for Each Catalyst)

Comparison of Light Gas Yields vs. Processing Severity
(Conditions: 1000 psig, 1.0 $h^{-1}$ LHSV for Each Catalyst)

Comparison of Naphtha Yields vs. Processing Severity
(Conditions: 1000 psig, 1.0 $h^{-1}$ LHSV for Each Catalyst)

Comparison of Diesel Yields vs. Processing Severity
(Conditions: 1000 psig, 1.0 $h^{-1}$ LHSV for Each Catalyst)

DUAL CATALYST SYSTEM FOR HYDROISOMERIZATION OF FISCHER-TROPSCH WAX AND WAXY RAFFINATE

FIELD OF THE INVENTION

The present invention relates to a process for converting Fischer-Tropsch wax to lube basestocks. More particularly, the present invention relates to converting Fischer-Tropsch waxes to lubes using a dual molecular sieve catalysts system.

BACKGROUND OF THE INVENTION

There is significant economic incentive to convert Fischer-Tropsch (F-T) wax to high quality lube basestocks, especially base oils with properties and performance comparable to, or better than, those of polyalphaolefins (PAO). The upgrading of Fischer-Tropsch wax greatly relies on advanced wax isomerization technology that transforms linear paraffins to multi-branched isoparaffins with minimal cracking.

Processes for converting Fischer-Tropsch wax to paraffinic lube base-stocks are known. A typical process is a two-stage process that hydroisomerizes Fischer-Tropsch wax to a waxy isoparaffins mixture in the first step, followed by either solvent dewaxing or catalytic dewaxing the waxy isoparaffins mixture in the second step to remove residual wax and achieve a target lube pour point.

The hydroisomerization catalysts disclosed previously, such as Pt supported on amorphous aluminosilicate or Zeolite Beta (Beta), normally possess large pores that allow the formation of branch structures during paraffin isomerization. Examples of other large pore molecular sieves include ZSM-3, ZSM-12, ZSM-20, MCM-37, MCM-68, ECR-5, SAPO-5, SAPO-37 and USY. However, these large pore catalysts are not selective enough to preferentially convert normal and lightly branched paraffin waxes in the presence of multi-branched isoparaffin molecules. As a result, the isoparaffin products derived from Fischer-Tropsch wax often contain residual wax that needs to be dewaxed in order to meet target lube cloud points or pour points. The cloud point of a lube is the temperature at which the first trace of wax stalls to separate, causing the lube to become turbid or cloudy (e.g., ASTM D2500). The pour point of a lube is the temperature at which lube and wax crystallize together as a whole and will not flow when poured (e.g., ASTM D97). Dewaxing can be achieved by additionally using either a solvent dewaxing process or a catalytic dewaxing process.

Most selective dewaxing catalysts used in a catalytic dewaxing process have relatively small pore structures and catalyze lube pour point reduction by selectively cracking normal and lightly branched paraffin waxes. Such dewaxing catalysts usually have low paraffin isomerization selectivity.

Few catalysts have been reported to be efficient in catalyzing both hydroisomerization and dewaxing of paraffin wax to low pour point lubes. One example of such catalysts is a noble metal, such as Pt, supported on SAPO-11. It was previously assumed that oval-shaped pore structures are common feature of isomerization and dewaxing catalysts. See, for example U.S. Pat. No. 5,246,566.

There remains a need therefore and a higher isomerization selectivity to achieve a low enough pour point with minimal molecular weight changes.

SUMMARY OF THE INVENTION

The present invention relates to a process for converting Fischer-Tropsch wax to high quality lube basestocks by contacting the wax with a molecular sieve catalyst (e.g., Zeolite Beta) followed by a unidimensional molecular sieve catalyst with a near circular pore structure having an average diameter of 0.50 nm to 0.65 nm wherein the difference between the maximum diameter and the minimum is ≦0.05 nm (e.g., ZSM-48). Both catalysts comprise one or more Group VIII metals (i.e., Fe, Ru, Os, Co, Rh, Ir, Pd, Pt, Ni).

DETAILED DESCRIPTION

Figure 1:
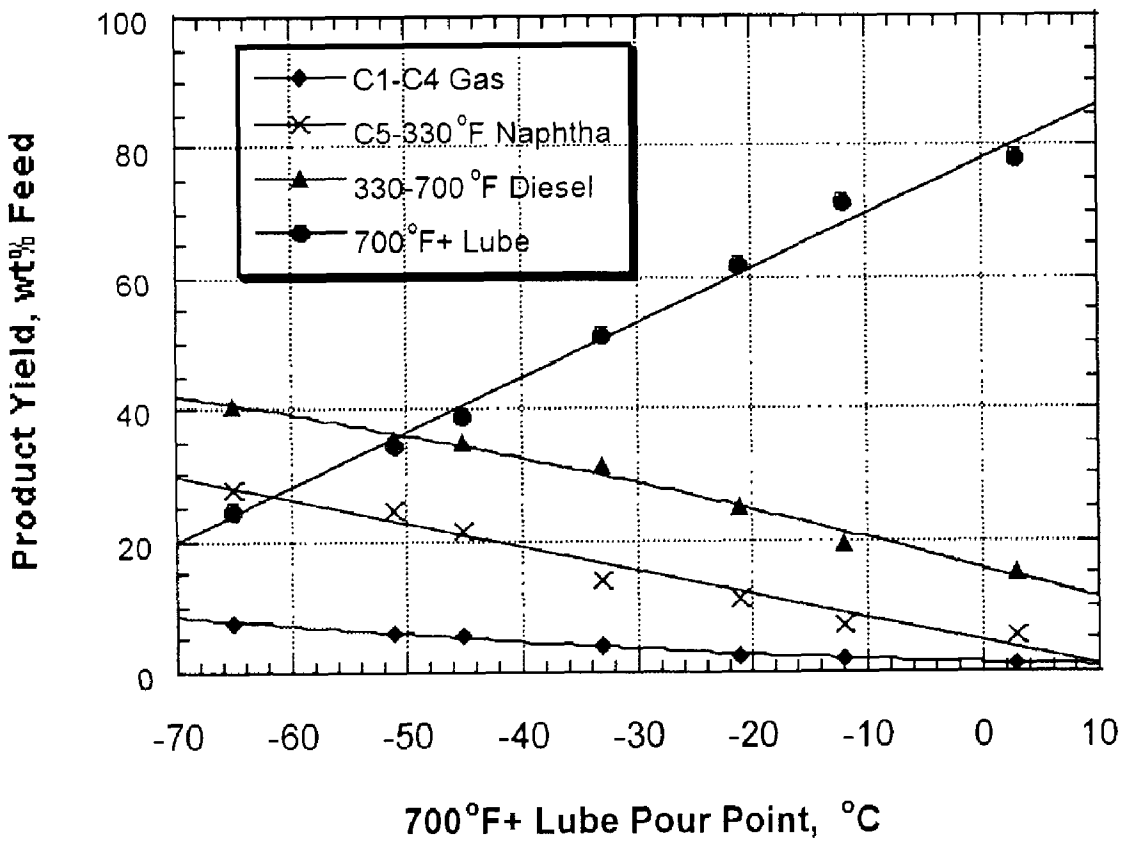
FIG. 1 is a plot of hydroisomerization yields versus lube pour point for lubes derived from SASOL™ C80 Fischer-Tropsch wax (C80) treated over Pt/Beta followed by Pt/ZSM-48.

The invention provides high isomerization and dewaxing selectivity of a F-T wax with a molecular sieve catalyst followed by a unidimensional catalyst molecular sieve with near circular pore structure having an average diameter of 0.50-0.65 nm (5.0-6.5 angstroms) wherein the maximum diameter-minimum diameter ≦0.05 nm (0.5 angstroms), to form a lubricant. Group VIII metals on the two catalysts are preferred and platinum is the most preferred. The invention improves lube basestock products and their properties (e.g., pour point, cloud point).

There is a synergy between the two catalysts. It is believed that the first catalyst (e.g., Zeolite Beta) improves yield and pour point by creating the first few branches while the second catalyst (i.e., a unidimensional molecular sieve catalyst) does most of the dewaxing with minimal cracking. This method can easily improve yield of high viscosity index (VI) lubes at a target pour point by 10% over prior methods.

Preferably, F-T wax feed is first passed over a single Zeolite Beta catalyst. The resulting intermediate product is then passed over a unidimensional molecular sieve catalyst to form the final lube. These first and second stages can be separated or preferably are integrated process steps (e.g., cascaded).

Zeolite Beta catalysts are 12 ring acidic silica/alumina zeolites with or without boron (replacing some of the aluminum atoms). Zeolite Y (USY), though less preferred than Beta, is also contemplated in the scope of the invention. Pre-sulfided Zeolite Beta is preferred when some residual sulfur in the product is acceptable.

Zeolite Betas used in the invention preferably have an Alpha value below 15, more preferably below 10, at least prior to metal loading. Alpha is an acidity metric that is an approximate indication of the catalytic cracking activity of the catalyst compared to a standard catalyst. Alpha is a relative rate constant (rate of normal hexane conversion per volume of catalyst per unit time). Alpha is based on the activity of the highly active silica-alumina cracking catalyst taken as an Alpha of 1 in U.S. Pat. No. 3,354,078 (incorporated by reference) and measured at 538° C. as described in the Journal of Catalysis, vol. 4, p. 527 (1965); vol. 6, p. 278 (1966); and vol. 61, p. 395 (1980). The use of Fischer Tropsch waxes and waxy raffinates requires a low Alpha value of the Zeolite Beta catalyst due to minimal nitrogen content in the feeds. In comparison, catalysts with high Alpha values are used for cracking. Alpha values may be reduced by steaming.

The Beta catalyst (e.g., Pt/Beta), when contacting the feed, is most preferably kept at temperatures of 400-700° F. (204-371° C.), more preferably at 500-650° F. (260-343° C.), and most preferably at 520-580° F. (271-304° C.).

The unidimensional molecular sieve catalyst with near-circular pore structures does most of the dewaxing. The pores are smaller than in large pore molecular sieves thereby excluding bulkier (e.g., highly branched) molecules. Unidimentional means that the pores are essentially parallel to each other.

The pores of the second catalyst have an average diameter of 0.50 nm to 0.65 nm wherein the difference between a minimum diameter and a maximum diameter is ≦0.05 nm. The pores may not always have a perfect geometric circular or elliptical cross-section. The minimum diameter and maximum diameter are generally only measurements of an ellipse of an cross-sectional area equal to the cross-sectional area of an average pore. The average pore diameter can be defined by finding the center of the pore cross-section, and measuring the minimum diameter and the maximum diameter across the center, and calculating the average of the two diameters.

The preferred unidimensional molecular sieve catalyst is an intermediate pore molecular sieve catalyst of which the preferred version is ZSM-48. U.S. Pat. No. 5,075,269 describes the procedures for making ZSM-48 and is incorporated by reference herein. ZSM-48 is roughly 65% zeolite crystal and 35% alumina. Of the crystals, at least 90%, preferably at least 95%, and most preferably 98-99% are ideal crystals. The ZSM-48 is preferably in the protonated form though some sodium is acceptable. ZSM-48 is more robust than other catalysts with similar functions. However, ZSM-48 is preferably used with ultraclean feeds such as F-T wax to avoid deactivation.

In the second stage of the process, the unidimensional intermediate pore molecular sieve catalyst (e.g., Pt/ZSM-48) is preferably kept at 500-800° F. (260-427° C.), more preferably at 600-700° F. (316-371° C.), and most preferably at 630-660° F. (332-349° C.). ZSM-48 catalysts used in the invention preferably have an Alpha value of about 10 to about 50 prior to metal loading.

The temperature of each catalyst is preferably controlled independently. Temperature choice partly depends on the feed liquid hourly space velocity of which 0.1-20 $h^{-1}$ is preferred, 0.5-5 $h^{-1}$ is more preferred, and 0.5-2 $h^{-1}$ is most preferred.

The contact time for both catalysts is preferably similar to each other. It is understood that the space velocity can be different. The pressure for both catalysts is preferably similar to each other. Hydrogen cofeed flow rate is 100-10,000 scf/bbl (17.8-1,780 $n.L.L^{-1}$), more preferably 1,000-6,000 scf/bbl (178-1,068 $n.L.L^{-1}$), and more preferably 1,500-3,000 scf/bbl (267-534 $n.L.L^{-1}$).

Each catalyst comprises 0.01-5 wt % of at least one Group VIII metal (i.e., Fe, Ru, Os, Co, Rh, Ir, Pd, Pt, Ni). Platinum and palladium are most preferred. Platinum or palladium blended with each other or other group VIII metals follow in preference. Nickel may also be blended with group VIII precious metals and is included in the scope of the invention whenever group VIII blends, alloys, or mixtures are mentioned. Preferred metal loading on both catalysts are 0.1-1 wt % with approximately 0.6 wt % most preferred.

The feed is preferably F-T wax with a melting point over 50° C., less than 7,000 ppm sulfur, and less than 50 ppm nitrogen. The nitrogen is preferably significantly less than 50 ppm if hydrogen pressure is greater than 500 psig (34 atm).

The feed is converted by the Zeolite Beta catalyst to form an intermediate product which is then preferably passed directly from the Beta catalyst to the unidimensional intermediate pore molecular sieve catalyst. In a preferred embodiment of the invention, a cascaded two-bed catalyst system consisting of a first bed Pt/Beta (i.e., platinum on Zeolite Beta) catalyst followed by a second bed Pt/ZSM-48 catalyst allows a highly selective process for wax isomerization and lube hydrodewaxing with minimal gas formation. In cascading, the intermediate product preferably directly passes from the first bed to the second bed without inter-stage separation. Optionally, light byproducts (e.g., methane, ethane) can be removed between the Beta and unidimensional intermediate pore molecular sieve catalysts.

Feeds usually have at least about 95% n-paraffins and a boiling point distribution of at least 500-1300° F. (260-704° C.). Preferred feed contains $C_{24}$-$C_{60}$ with tail having a $T_5$ of about 700° F. (371° C.) and a $T_{95}$ of about 1100° F. (593° C.) with less than 1,000 ppm and preferably less than 200 ppm sulfur or nitrogen. More branching in feed structures facilitates the present invention and improves its yield. U.S. Pat. No. 6,090,989 describes typical branching indices and is incorporated by reference. The feed is preferably mixed with hydrogen and preheated before contacting it with the Beta catalyst. Preferably, at least 95% of the wax is in liquid form before contacting it with the Beta catalyst.

The preferred measurements, as taught by the specification, are described in this paragraph. Where there are two values, the value in parenthesis are approximate metric conversions of the first value. The weight percent of paraffins may be measured by high-resolution $^{1}H$-NMR, for example, by the method described in ASTM standard D5292, in combination with GC-MS. This approach may also be used to determine the weight percentage of unsaturates, alcohols, oxygenates, and other organic components. The iso- to normal-paraffin ratio may be measured by performing gas chromatography (GC) or GC-MS in combination with $^{13}C$-NMR. Sulfur may be measured by XRF (X-Ray Fluorescence), as described, for example, in ASTM standard D2622. Nitrogen may be measured by syringe/inlet oxidative combustion with chemiluminescence detection, for example, by the method described in ASTM standard D4629. Aromatics may be measured as described below. As taught by the specification, olefins may be measured by using a Bromine index determined by coulemetric analysis, for example, by using ASTM standard D2710. The weight percent of total oxygen may be measured by neutron activation in combination with high-resolution $^1$H-NMR. If necessary, the total oxygen content may be placed on a water-free basis by measuring water content. For samples having a water content known to be less than about 200 ppm by weight, one may use known derivitization methods (e.g., by using calcium carbide to form acetylene) followed by GC-MS. For samples having a water content known to be greater than about 200 ppm by weight, one may use the Karl-Fischer method, for example, by the method described in ASTM standard D4928. The total alcohol content may be determined by high-resolution $^1$H-NMR, and the percentage present primarily as $C_{12}$-$C_{24}$ primary alcohols may be determined by GC-MS. Cetane number may be determined by using, for example, ASTM standard D613. The level of aromatics may be determined by using high-resolution $^1$H-NMR, for example, by using ASTM standard D5292. Dioxygenates are measured by using infrared (IR) absorbance spectroscopy.

Branching characteristics of iso-paraffins may be measured by a combination of high-resolution $^{13}$C-NMR and GC with high-resolution MS.

EXPERIMENTAL

A cascaded two-bed catalyst system consisting of a first stage Pt/Beta catalyst immediately followed by a second stage of Pt/ZSM-48 catalyst is shown to be highly active and selective for F-T wax hydroisomerization and dewaxing. A combination of Pt/ZSM-48 followed by Pt/Beta and standalone Pt/ZSM-48 were less effective. The use of the Beta catalyst in front of Pt/ZSM-48 has minimal effects on lube viscosity-pour point or viscosity index-pour point correlation. The isomerization of SASOL™ C80 F-T wax resulted in high lube yield and only small amount of gas over a wide range of processing severity. Detailed preferred operating conditions, material balance data, tube yields and properties are summarized in Table 1. TBP x % indicates temperature below which x wt % of hydrocarbon samples boils. The total product distribution at various processing severity is shown in FIG. 1. Time on stream (TOS) is the time during which the feed contacts the catalyst. IBP is initial boiling point. TBP is terminal boiling point. The best S.I. equivalent of standard cubic feet of hydrogen per barrel of feed (SCF/bbl) is normal liters of hydrogen gas per liter of feed (n.l.l$^{-1}$. or n.L.L$^{-1}$ or n.L (gas)/L (feed)). LHSV is defined as liquid hourly space velocity. WHSV is defined as weight hourly space velocity.

TABLE 1

Hydroisomerization of SASOL ™ C80 Fischer-Tropsch Wax Catalyzed by a Cascaded Pt/Beta Followed by Pt/ZSM-48 (1.0 h$^{-1}$ LHSV for Each Catalyst)

| | | Run Number 401- | | | | | | |
|---|---|---|---|---|---|---|---|---|
| | | 3-34 | 3-37 | 3-38 | 3-41 | 3-50 | 3-53 | 3-55 |
| Time on Stream, Days | | 47.7 | 50.7 | 51.7 | 56.1 | 70.1 | 73.7 | 77.2 |
| Beta Temperature, ° F. | | 580 | 560 | 540 | 560 | 540 | 520 | 520 |
| Beta Temperature, ° C. | approximate | 304 | 293 | 282 | 293 | 282 | 271 | 271 |
| ZSM-48 Temperature, ° F. | | 630 | 660 | 660 | 640 | 640 | 660 | 650 |
| ZSM-48 Temperature, ° C. | approximate | 332 | 349 | 349 | 338 | 338 | 349 | 343 |
| Pressure, psig | | 1000 | 1000 | 1000 | 1000 | 1000 | 1000 | 1000 |
| (Pressure, atm) | approximate | 68 | 68 | 68 | 68 | 68 | 68 | 68 |
| $H_2$ Cofeeding Rate, scf/bbl | | 5477 | 5188 | 5228 | 4965 | 5610 | 5790 | 5332 |
| ($H_2$ Cofeeding Rate, n.L.L$^{-1}$) | approximate | 975 | 923 | 931 | 884 | 999 | 1031 | 949 |
| 700° F.+ (371° C.+) Conversion, wt % | | 22.0 | 60.9 | 65.3 | 28.6 | 38.2 | 75.2 | 48.8 |
| $H_2$ Consumption, scf/bbl | | 110 | 392 | 435 | 150 | 211 | 511 | 286 |
| ($H_2$ Consumption, n.L.L$^{-1}$) | approximate | 18 | 70 | 77 | 27 | 38 | 91 | 51 |
| Product Yield, wt % on Feed | | | | | | | | |
| $C_1$—$C_4$ Gas | | 1.4 | 5.5 | 6.0 | 2.1 | 2.4 | 7.7 | 4.0 |
| $C_5$–330° F. (166° C.) Naphtha | | 5.5 | 21.3 | 24.6 | 7.3 | 11.3 | 27.8 | 14.0 |
| 330-700° F. Diesel (166-371° C.) | | 15.2 | 34.8 | 35.5 | 19.5 | 24.9 | 40.6 | 31.4 |
| 700° F.+ Lube (371° C.+) | | 78.0 | 39.1 | 34.7 | 71.4 | 61.8 | 24.8 | 51.2 |
| Total Hydrocarbon | | 100.2 | 100.7 | 100.8 | 100.3 | 100.4 | 100.9 | 100.5 |
| 700° F.+ (371° C.+) Lube Properties | Feed | | | | | | | |
| KV @ 40° C., cSt | | 35.0 | 33.6 | 35.9 | 29.7 | 30.2 | 25.6 | 23.5 |
| KV @ 100° C., cSt | 9.4 | 7.20 | 6.49 | 6.71 | 6.32 | 6.35 | 5.20 | 5.16 |
| Viscosity Index | | 175.5 | 149.8 | 145.9 | 171.2 | 168.9 | 138.1 | 157.1 |
| Pour Point, ° C. | 82 | 3 | −45 | −51 | −12 | −21 | −65 | −33 |
| Cloud Point, ° C. | | 25 | −16 | −51 | 12 | 9 | −65 | — |
| TBP 5%, ° F. | | 780 | 754 | 781 | 697 | 717 | 681 | 639 |
| TBP 5%, ° C. | approximate | 416 | 401 | 416 | 366 | 380 | 360 | 337 |
| TBP 50%, ° F. | | 926 | 896 | 903 | 915 | 907 | 852 | 855 |
| TBP 50%, ° C. | approximate | 497 | 480 | 484 | 491 | 486 | 455 | 457 |
| TBP 95%, ° F. | | 1056 | 1030 | 1030 | 1056 | 1051 | 1024 | 1014 |
| TBP 95%, ° C. | approximate | 569 | 554 | 554 | 569 | 566 | 551 | 546 |
| MB Closure, wt % | | 99.1 | 97.1 | 98.5 | 97.5 | 98.2 | 99.8 | 99.4 |

To obtain desirable wax isomerization results, a mild (e.g., 500-630° F. (260-332° C.)) first bed Pt/Beta temperature should be employed during lube hydroprocessing. The mild Pt/Beta temperature should be employed with varying Pt/ZSM-48 temperature to achieve a target lube pour point. At a constant Pt/ZSM-48 (second bed) temperature, a high Pt/Beta temperature was found to have negative effects on (i.e., increase) lube pour point. To achieve maximal lube yield, low operating pressure (<2,000 psi (136 atm) hydrogen pressure) should be used.

Figure 2:
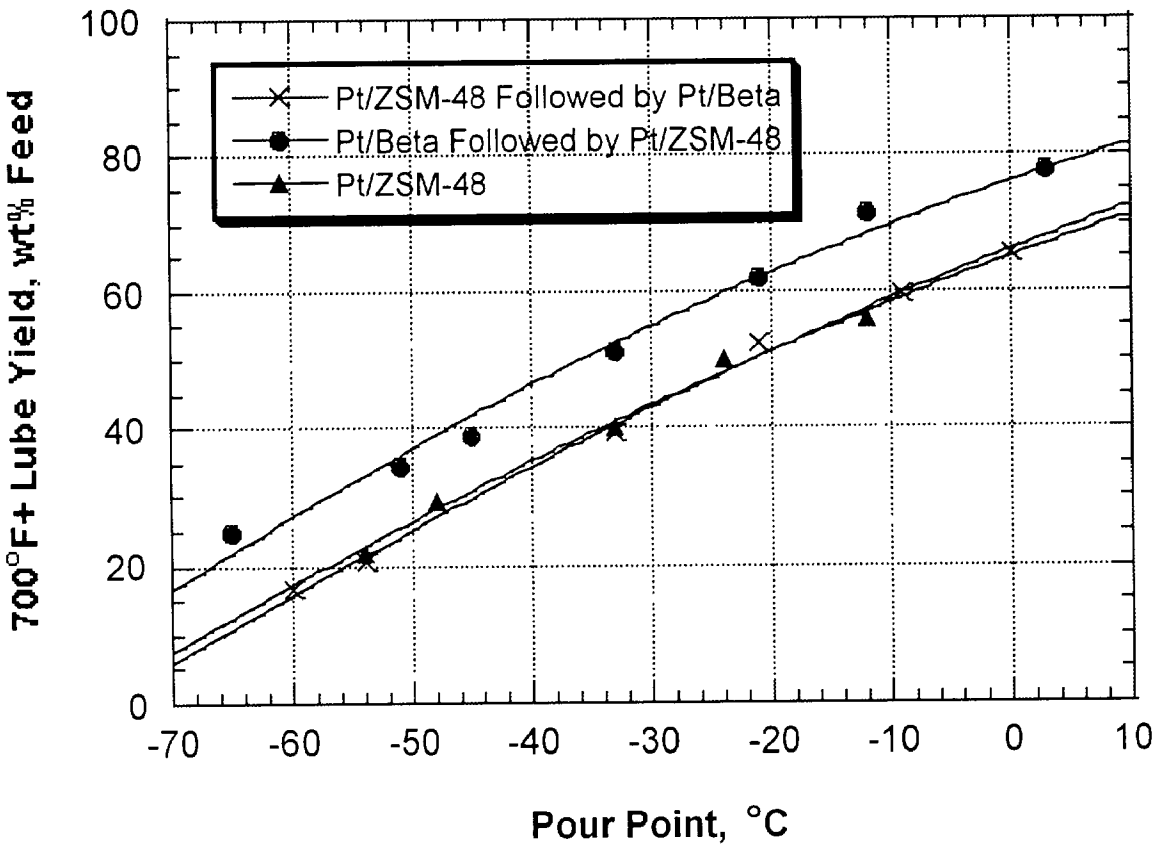
FIG. 2 is a plot of lube yield versus lube pour point for isomerization of C80 wax over Pt/Beta followed by Pt/ZSM-48, Pt/ZSM-48 followed by Pt/Beta, and stand-alone Pt/ZSM-48 catalyst systems.

A cascaded Pt/ZSM-48 followed by Pt/Beta and stand-alone Pt/ZSM-48 were also evaluated and it was found that both catalyst systems were less selective in isomerizing and dewaxing C80 F-T wax to 700° F.+ (371° C.+) lube basestocks (Tables 2 and 3). Comparison of lube yields for the three catalyst systems tested is illustrated in FIG. 2. Pt/Beta followed by Pt/ZSM-48 gave approximately 10 wt % higher lube yield at a given pour point than Pt/ZSM-48 followed by Pt/Beta or Pt/ZSM-48 alone.

TABLE 2

Hydroisomerization of SASOL ™ C80 Fischer-Tropsch Wax Catalyzed by Pt/ZSM-48

| | | Run Number, 401- | | | | |
|---|---|---|---|---|---|---|
| | | 3-27 | 3-28 | 3-29 | 3-30 | 3-31 |
| Time on Stream, Days | | 35.6 | 37.0 | 38.0 | 39.0 | 40.9 |
| Temperature, ° F. | | 665 | 660 | 655 | 650 | 645 |
| Temperature, ° C. | approximate | 352 | 349 | 352 | 343 | 341 |
| Pressure, psig | | 1000 | 1000 | 1000 | 1000 | 1000 |
| (Pressure, atm) | approximate | 68 | 68 | 68 | 68 | 68 |
| LHSV, $hr^{-1}$ | | 1.0 | 1.0 | 1.0 | 1.0 | 1.0 |
| WHSV, $hr^{-1}$ | | 1.4 | 1.5 | 1.5 | 1.4 | 1.4 |
| $H_2$ Cofeeding Rate, scf/bbl | | 5656 | 5643 | 5603 | 5674 | 5657 |
| ($H_2$ Cofeeding Rate, $n.L.L^{-1}$) | approximate | 1007 | 1004 | 997 | 1010 | 1007 |
| 700° F.+ (371° C.+) Conversion, wt % | | 78.0 | 70.6 | 60.0 | 49.9 | 44.2 |
| $H_2$ Consumption, scf/bbl | | 544 | 473 | 377 | 306 | 261 |
| ($H_2$ Consumption, $n.L.L^{-1}$) | approximate | 97 | 84 | 67 | 54 | 46 |
| Product Yield, wt % on Feed | | | | | | |
| $C_1$—$C_4$ Gas | | 8.3 | 6.8 | 5.4 | 4.4 | 3.5 |
| $C_5$–330° F. ($C_5$-166° C.) Naphtha | | 30.0 | 26.1 | 19.6 | 15.6 | 13.7 |
| 330-700° F. (166-371° C.) Diesel | | 40.8 | 38.6 | 35.7 | 30.4 | 27.5 |
| 700° F.+ (371° C.+) Lube | | 22.0 | 29.4 | 40.0 | 50.1 | 55.8 |
| Total Hydrocarbon | | 101.0 | 100.9 | 100.7 | 100.6 | 100.5 |
| 700° F.+ (371° C.+) Lube Properties | Feed | | | | | |
| KV @ 40° C., cSt | | 14.8 | 34.8 | 31.2 | 32.9 | 34.0 |
| KV @ 100° C., cSt | 9.4 | 3.65 | 6.59 | 6.29 | 6.66 | 6.90 |
| Viscosity Index | | 135.5 | 147.4 | 156.9 | 163.8 | 168.6 |
| Pour Point, ° C. | 82 | −54 | −48 | −33 | −24 | −12 |
| TBP 5%, ° F. | | 570 | 778 | 753 | 766 | 770 |
| (TBP 5%, ° C.) | approximate | 299 | 414 | 400 | 407 | 410 |
| TBP 50%, ° F. | | 783 | 899 | 906 | 918 | 918 |
| (TBP 50%, ° C.) | approximate | 417 | 482 | 485 | 492 | 492 |
| TBP 95%, ° F. | | 998 | 997 | 1007 | 1014 | 1057 |
| (TBP 95%, ° C.) | approximate | 537 | 536 | 542 | 546 | 569 |
| MB Closure, wt % | | 99.6 | 98.8 | 98.8 | 97.9 | 97.1 |

TABLE 3

Hydroisomerization of SASOL ™ C80 Fischer-Tropsch Wax Catalyzed by a Cascaded Pt/ZSM-48 Followed by Pt/Beta (1.0 $h^{-1}$ LHSV for Each Catalyst)

| | | Run Number, 401- | | | | | |
|---|---|---|---|---|---|---|---|
| | | 3-3 | 3-11 | 3-16 | 3-20 | 3-22 | 3-24 |
| Time on Stream, Days | | 3.6 | 15.1 | 21.6 | 26.5 | 28.6 | 31.1 |
| ZSM-48 Temperature, ° F. | | 660 | 660 | 640 | 655 | 645 | 640 |
| (ZSM-48 Temperature, ° C.) | approximate | 349 | 349 | 338 | 346 | 341 | 338 |
| Beta Temperature, ° F. | | 560 | 560 | 540 | 560 | 560 | 560 |
| (Beta Temperature, ° C.) | approximate | 293 | 293 | 282 | 293 | 293 | 293 |
| Pressure, psig | | 1000 | 1000 | 1000 | 1000 | 1000 | 1000 |
| (Pressure, atm) | approximate | 68 | 68 | 68 | 68 | 68 | 68 |
| $H_2$ Cofeeding Rate, scf/bbl | | 5786 | 6150 | 5575 | 5528 | 5607 | 5619 |
| ($H_2$ Cofeeding Rate, $n.L.L^{-1}$) | approximate | 1030 | 1095 | 992 | 984 | 5607 | 1000 |
| 700° F.+ (371° C.) Conversion, wt % | | 83.5 | 79.4 | 34.6 | 60.7 | 47.7 | 40.4 |
| $H_2$ Consumption, scf/bbl | | 499 | 516 | 205 | 377 | 270 | 225 |
| ($H_2$ Consumption, $n.L.L^{-1}$) | approximate | 89 | 92 | 36 | 67 | 48 | 40 |
| Product Yield, wt % on Feed | | | | | | | |
| $C_1$—$C_4$ Gas | | 4.0 | 6.2 | 3.2 | 5.7 | 3.4 | 2.8 |
| $C_5$-330° F. ($C_5$-166° C.) Naphtha | | 33.4 | 31.2 | 9.6 | 18.2 | 13.2 | 11.4 |

TABLE 3-continued

Hydroisomerization of SASOL ™ C80 Fischer-Tropsch Wax Catalyzed by a Cascaded Pt/ZSM-48 Followed by Pt/Beta (1.0 $h^{-1}$ LHSV for Each Catalyst)

| | | Run Number, 401- | | | | | |
|---|---|---|---|---|---|---|---|
| | | 3-3 | 3-11 | 3-16 | 3-20 | 3-22 | 3-24 |
| 330-700° F. (166-371° C.) Diesel | | 47.0 | 42.9 | 22.1 | 37.5 | 31.6 | 26.6 |
| 700° F.+ (371° C.+) Lube | | 16.5 | 20.6 | 65.4 | 39.3 | 52.3 | 59.6 |
| Total Hydrocarbon | | 100.9 | 101.0 | 100.4 | 100.7 | 100.5 | 100.4 |
| 700° F.+ (371° C.+) Lube Properties | Feed | | | | | | |
| KV @ 40° C., cSt | | 34.7 | 24.8 | 34.0 | 28.1 | 28.8 | 28.3 |
| KV @ 100° C., cSt | 9.4 | 6.31 | 5.06 | 6.91 | 5.77 | 5.98 | 6.00 |
| Viscosity Index | | 133.5 | 136.0 | 168.7 | 153.4 | 159.8 | 165.2 |
| Pour Point, ° C. | 82 | −60 | −54 | 0 | −33 | −21 | −9 |
| Cloud Point, ° C. | | −60 | −54 | 13 | 0 | −10 | 4 |
| TBP 5%, ° F. | | 754 | 702 | 783 | 723 | 719 | 716 |
| (TBP 5%, ° C.) | approximate | 401 | 372 | 417 | 384 | 382 | 380 |
| TBP 50%, ° F. | | 875 | 840 | 922 | 877 | 879 | 895 |
| (TBP 50%, ° C.) | approximate | 468 | 449 | 494 | 469 | 471 | 479 |
| TBP 95%, ° F. | | 1004 | 1006 | 1062 | 1030 | 1019 | 1028 |
| (TBP 95%, ° C.) | approximate | 540 | 541 | 572 | 554 | 548 | 553 |
| MB Closure, wt % | | 97.6 | 95.6 | 98.2 | 98.5 | 98.0 | 98.1 |

Approximately 5° F. (2.8° C.) less Pt/ZSM-48 temperature is required to achieve a target pour point when a cascaded Pt/Beta and Pt/ZSM-48 was used instead of stand-alone Pt/ZSM-48 (Tables 1 and 2). This resultant reduction of Pt/ZSM-48 severity should reduce the cracking activity of the catalyst and is assumed to be a primary contributor to the yield benefit for the dual catalyst system. The addition of Pt/Beta had minimal effects on the range of Pt/ZSM-48 operating temperature, which was also observed for the catalyst system Pt/ZSM-48 followed by Pt/Beta (Tables 2 and 3).

Figure 3:
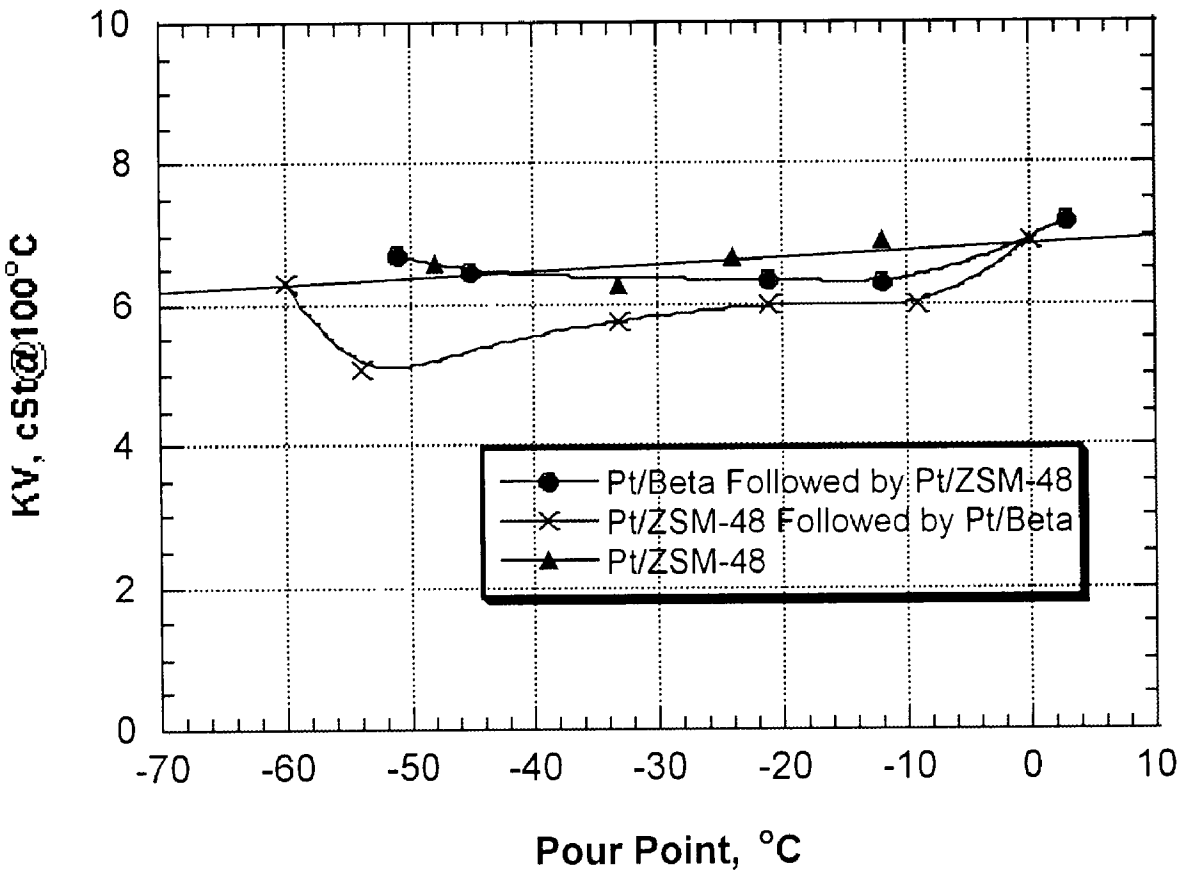
FIG. 3 is a plot of lube viscosity versus lube pour point for isomerization of C80 wax over Pt/Beta followed by Pt/ZSM-48, Pt/ZSM-48 followed by Pt/Beta, and stand-alone Pt/ZSM-48 catalyst systems.
Figure 4:
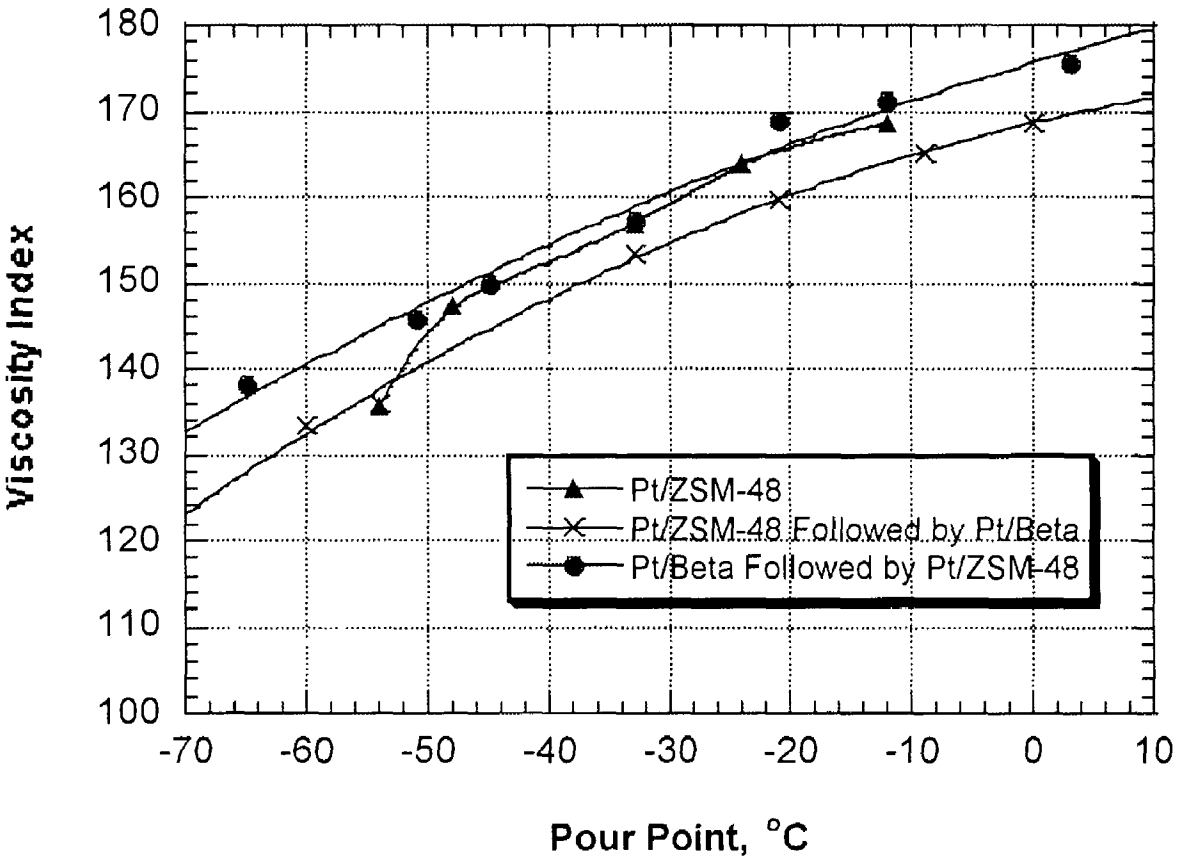
FIG. 4 is a plot of viscosity index (VI) versus lube pour point for isomerization of C80 wax over Pt/Beta followed by Pt/ZSM-48, Pt/ZSM-48 followed by Pt/Beta, and stand-alone Pt/ZSM-48 catalyst systems.

The viscosity and viscosity index of the nominal 700° F.+(371° C.+) C80 wax isomerates vs. hydroprocessing severity are plotted in FIGS. 3 and 4, respectively. The three sets of data compared in the two diagrams correspond to the F-T wax isomerates prepared using Pt/Beta followed by Pt/ZSM-48, Pt/ZSM-48 followed by Pt/Beta, and Pt/ZSM-48 alone. For products of the invention, a viscosity index of at least 160 at a −20° C. lube pour point and a viscosity index of at least 135 at a pour point of no more than −50° C. is preferred.

As shown in FIG. 3, the viscosity of the Pt/Beta-Pt/ZSM-48 F-T lubes changes only slightly vs. pour point and is very close to that of the Pt/ZSM-48 lubes. The small viscosity differences are also partially attributable to variation in the initial boiling point of the actual 700° F.+(371° C.+) distillation cuts. However, the Pt/ZSM-48-Pt/Beta F-T isomerates had lower viscosities presumably due to the relatively high cracking activity of Pt/Beta catalyst towards multi-branched isoparaffins. The cracking activity of Pt/Beta with pure wax or lightly branched paraffins should be low as in the case of C80 wax isomerization catalyzed by Pt/Beta followed by Pt/ZSM-48 system.

The viscosity index of the Pt/Beta-Pt/ZSM-48 F-T lubes is similar to that of the Pt/ZSM-48 isomerates except at an extremely low pour point (FIG. 4). For comparison, Pt/ZSM-48 followed by Pt/Beta yields a lower lube VI at a given pour point (e.g., 4-9 viscosity index numbers). The VI differences observed for the three catalyst systems could be attributable to the higher shape selectivity of ZSM-48 vs. Zeolite Beta towards multi-branched isoparaffins. During the wax hydroisomerization process, the smaller pore structure of ZSM-48 (0.53×0.56 nm, unidimensional) could effectively exclude highly branched, low pour, paraffins and selectively convert waxy normal paraffins or lightly branched paraffins, thus prohibiting the formation of excessively branched (or low VI) isomers. However, the large pore structure of Zeolite Beta (0.64×0.76 nm) is expected to be less shape-selective and possibly continue to transform highly branched paraffins to even more branched molecules, which would, of course, lower VI of the lube product and cause the catalyst being less effective in reducing lube pour point. The easy accessibility of Beta Zeolite's larger pore structure to highly branched isoparaffins also promotes cracking of these hydrocarbon molecules, resulting in a lower lube viscosity and yield. More details regarding the shape selectivity of ZSM-48 in lube isomerization and dewaxing will be discussed in the following sections.

The spread between the lube cloud and pour points for Pt/Beta-Pt/ZSM-48 and Pt/ZSM-48-Pt/Beta is typically less than 30° C. (Tables 1 and 3). In general, the spread between the lube cloud and pour points narrows with decreasing pour point.

A combination of Pt/Beta followed by Pt/ZSM-48 exhibited an unusual relationship between reaction temperature and lube product pour point during the wax hydroisomerization (Table 4). At constant Pt/Beta temperature, the lube pour point decreases with increasing Pt/ZSM-48 temperature. However, at constant Pt/ZSM-48 temperature, the lube pour point increases with increasing Pt/Beta temperature.

TABLE 4

Hydroisomerization of SASOL ™ C80 F-T Wax to Lubes Catalyzed by Pt/Beta Followed by Pt/ZSM-48 (Conditions: 1000 psig (68 atm), 1.0 $h^{-1}$ LHSV for Each Catalyst)

| | | | | | | | |
|---|---|---|---|---|---|---|---|
| Beta Temp. (° F.) | 560 | 560 | 560 | 520 | 540 | 560 | 580 |
| Beta Temp. (approx. ° C.) | 293 | 293 | 293 | 271 | 282 | 293 | 304 |
| ZSM-48 Temp. (° F.) | 630 | 645 | 660 | 660 | 645 | 645 | 645 |
| ZSM-48 Temp. (approx. ° C.) | 332 | 341 | 349 | 349 | 341 | 341 | 341 |
| Lube Properties | | | | | | | |
| Pour Point, ° C. | 15 | −15 | −45 | −65 | −18 | −15 | −9 |
| KV @ 100° C., cSt | 7.60 | 7.16 | 6.49 | 5.20 | 6.62 | 7.16 | 6.01 |
| Viscosity Index | 179.2 | 167.8 | 149.8 | 138.1 | 165.2 | 167.8 | 173.4 |

Since degree of branching of the Pt/Beta isomerates is anticipated to increase at high Beta temperature, this experimental result indicates that Pt/ZSM-48 is more effective in isomerizing and dewaxing less branched isoparaffins, and thus is shape selective. In case that a feed contains both lightly is branched and highly branched isoparaffins, it is likely that the ZSM-48 catalyst would preferentially convert/isoimerize the lightly branched molecules. This explains why Pt/ZSM-48 is an efficient catalyst for reducing lube pour point.

The shape selectivity of the catalyst is presumably due to its relatively small pore structure (0.53×0.56 nm, unidimensional) capable of differentiating different isoparaffins. The ability of ZSM-48 to preferentially convert normal paraffins or lightly branched paraffins and exclude highly branched isoparaffins reduces undesirable reactions such as cracking (leading to low lube yield) and excessive further isomerization (leading to low VI) of low pour, highly branched isomers. This is consistent with the low cracking activity, high lube yield, minimal viscosity loss, and high lube VI observed for Pt/ZSM-48 in isomerizing and dewaxing various waxy feeds including F-T waxes.

The correlation between reaction temperature and lube pour point was found to be normal for Pt/ZSM-48 followed by Pt/Beta (Table 5). The lube pour point decreases either with increasing Pt/ZSM-48 temperature and constant Pt/Beta temperature or with constant Pt/ZSM-48 temperature and increasing Pt/Beta temperature. This is not unexpected since the large pore Beta should be less selective than ZSM-48 in reacting with various branched isoparaffins, and would convert even highly branched paraffin isomers via cracking and additional isomerization.

Figure 5:
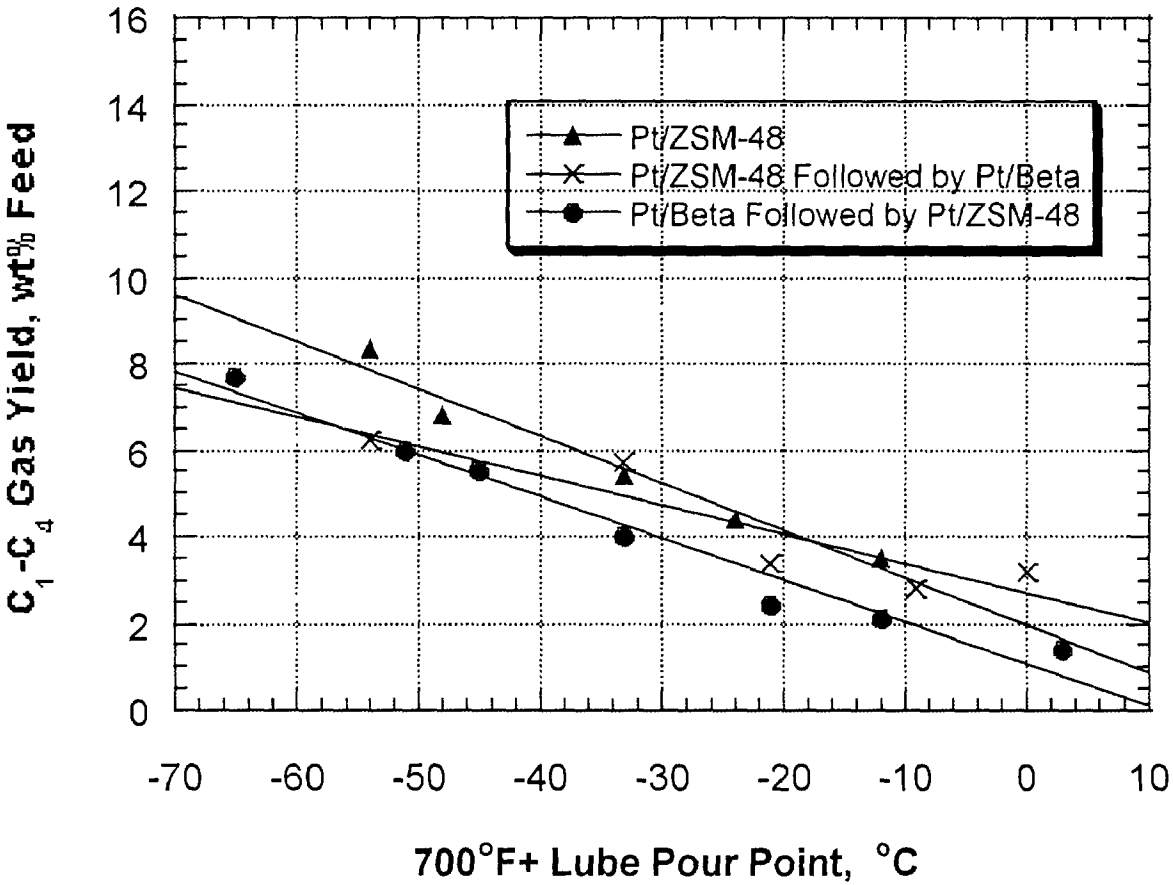
FIG. 5 is a plot of light gas yields versus lube pour point for isomerization of C80 wax over Pt/Beta followed by Pt/ZSM-48, Pt/ZSM-48 followed by Pt/Beta, and stand-alone Pt/ZSM-48 catalyst systems.
Figure 6:
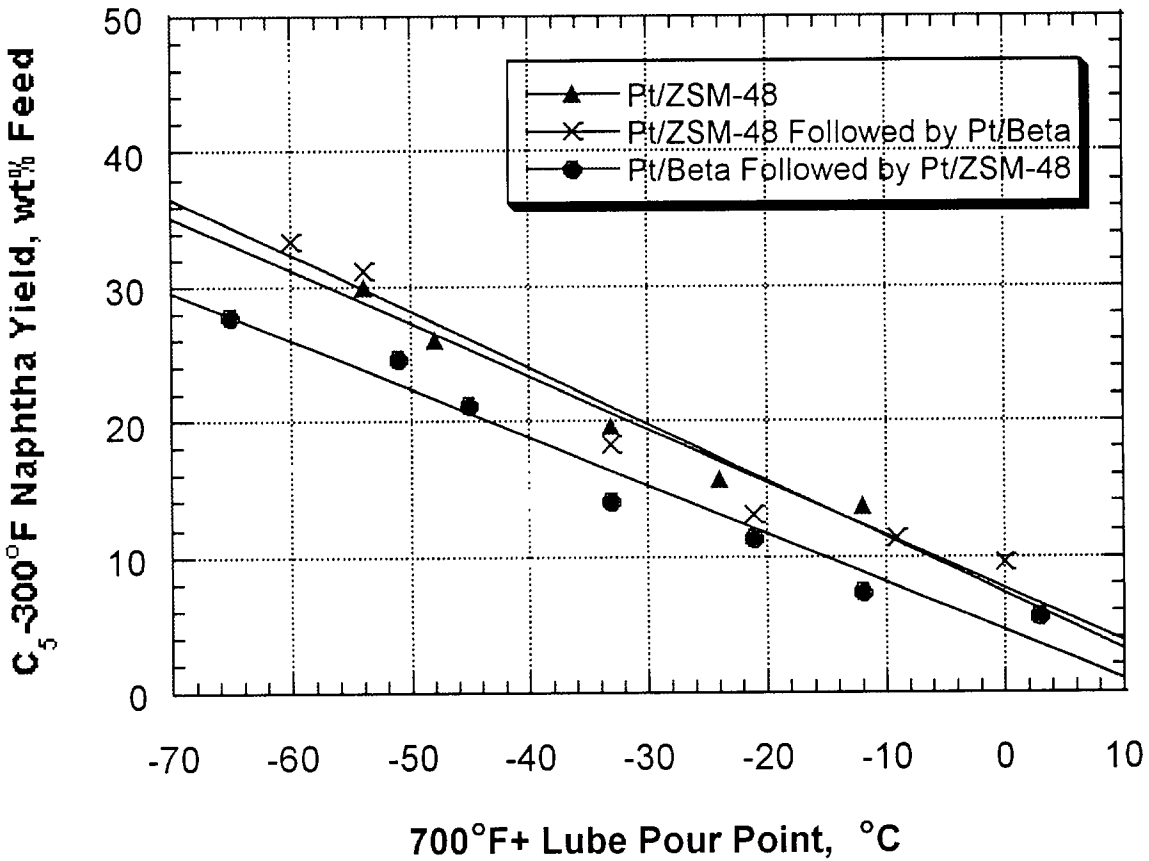
FIG. 6 is a plot of naphtha yields versus lube pour point for isomerization of C80 wax over Pt/Beta followed by Pt/ZSM-48, Pt/ZSM-48 followed by Pt/Beta, and stand-alone Pt/ZSM-48 catalyst systems.
Figure 7:
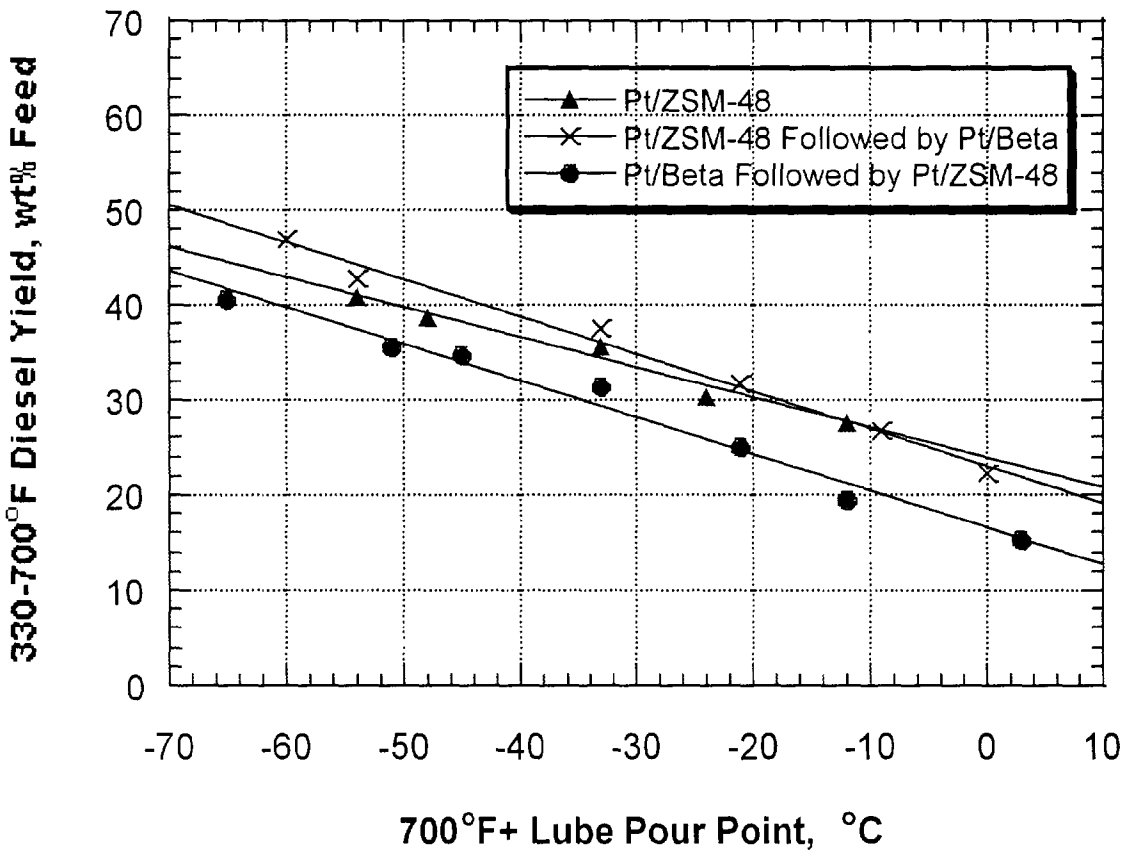
FIG. 7 is a plot of diesel yields versus lube pour point for isomerization of C80 wax over Pt/Beta followed by Pt/ZSM-48, Pt/ZSM-48 followed by Pt/Beta, and stand-alone Pt/ZSM-48 catalyst systems.

Pt/Beta-Pt/ZSM-48 system has superior isomerization selectivity and low cracking activity, and gives lower yields of light gases, naphtha, and diesel than Pt/ZSM-48-Pt/Beta and Pt/ZSM-48 alone (FIGS. 5-7). The overall light byproduct selectivity for the latter two catalysts is comparable. As expected, the yields of gases, naphtha, and diesel increase for all catalysts with increasing process severity (decreasing lube pour point) that promotes hydrocracking.

The following examples will serve to illustrate the invention.

Example 1

Feedstock. The hydrotreated SASOL™ PARAFLINT™ C80 Fischer-Tropsch wax feed was obtained from Moore and Munger, Inc., (Shelton, Conn.) and used as received without additional pretreatment. The C80 wax was a mixture of predominantly linear paraffins with very low content of olefins and oxygenates. SASOL™ has been marketing three commercial grades of F-T waxes: PARAFLINT™ H1, a 700° F.+(371° C.+) full range Fischer-Tropsch wax; PARAFLINT™ C80 and C105, 700-1100° F. (371-593° C.) and 1100° F.+(593° C.+) distillate fractions, respectively. The molecular weight distribution (in terms of boiling point) of the waxes is illustrated briefly in Table 6.

TABLE 5

Hydroisomerization of SASOL ™ C80 F-T Wax to Lubes Catalyzed by Pt/ZSM-48 Followed by Pt/Beta (Conditions: 1000 psig (68 atm), 1.0 $h^{-1}$ LHSV for Each Catalyst)

| | | | | | | |
|---|---|---|---|---|---|---|
| ZSM-48 Temp. (° F.) | 640 | 640 | 640 | 640 | 655 | 660 |
| ZSM-48 Temp. (approx. ° C.) | 338 | 338 | 338 | 338 | 346 | 349 |
| Beta Temp. (° F.) | 530 | 560 | 590 | 560 | 560 | 560 |
| Beta Temp. (approx. ° C.) | 277 | 293 | 310 | 293 | 293 | 293 |
| Lube Properties | | | | | | |
| Pour Point, ° C. | 0 | −18 | −45 | −18 | −33 | −54 |
| KV @ 100° C., cSt | 6.92 | 5.97 | 5.16 | 5.97 | 5.77 | 5.06 |
| Viscosity Index | 169.4 | 158.0 | 138.4 | 158.0 | 153.4 | 136.0 |

TABLE 6

Molecular Weight Distribution of SASOL ™ Fischer-Tropsch Waxes

| F-T Wax Feed | H1 | C80 | C105 |
|---|---|---|---|
| Pour Point, ° C. | 99 | 82 | 106 |
| IBP-700° F. (<$C_{24}$), wt % | 0 | 3 | 0 |
| 700-1100° F. ($C_{24}$-$C_{60}$), wt % | 44 | 89 | 20 |
| 1100° F.+ (>$C_{60}$), wt % | 56 | 8 | 80 |

Example 2

Preparation of Pt/Beta Catalyst. Pt/Beta catalyst was prepared by extruding a water-containing mull mix or paste containing 65 parts of Zeolite Beta with 35 pails of alumina (dry basis). After drying, the Zeolite Beta containing catalyst was calcined under nitrogen at 900° F. (482° C.) and exchanged at ambient temperature with a sufficient quantity of ammonium nitrate to remove residual sodium in the zeolite channels. The extrudate was then washed with de-ionized water and calcined in air at 1000° F. (538° C.). After air calcination, the 65% Zeolite Beta/35% Alumina extrudate was steamed at 1020° F. (549° C.) to reduce the Alpha value of the calcined catalyst to less than 10. The steamed, 65% low acidity Beta/35% Alumina catalyst was ion exchanged with a tetra-ammine platinum chloride solution under ion exchange conditions to uniformly produce a catalyst containing 0.6% Pt. After washing with de-ionized water to remove residual chlorides, the catalyst was dried at 250° F. (121° C.) followed by a final air calcination at 680° F. (360° C.).

Example 3

Preparation of Pt/ZSM-48 Catalyst. Pt/ZSM-48 catalyst was prepared by extruding a water-containing mull mix or paste containing 65 pails of ZSM-48 with 35 pails of alumina (dry basis). After drying, the ZSM-48 containing catalyst was calcined under nitrogen at 900° F. (482° C.) and exchanged at ambient temperature with a sufficient quantity of ammonium nitrate to remove residual sodium in the zeolite channels. The extrudate was then washed with deionized water and calcined in air at 1000° F. (538° C.). After air calcination, the 65% ZSM-48/35% Alumina catalyst was impregnated with a tetraammine platinum nitrate solution under incipient wetness conditions to uniformly produce a catalyst containing 0.6% Pt. Finally, the catalyst was dried at 250° F. (121° C.) followed by air calcination at 680° F. (360° C.).

Example 4

Wax Hydroprocessing. The wax hydroisomerization experiments were performed using a micro-unit equipped with two three-zone furnaces and two down-flow trickle-bed tubular reactors (½" ID) in cascade (with option to bypass the second reactor). The unit was carefully heat-traced to avoid freezing of the high melting point C80 wax. To reduce feed bypassing and lower zeolite pore diffusion resistance, the catalysts extrudates were crushed and sized to 60-80 mesh. The reactors 1 and 2 were then loaded with 15 cc of the 60-80 mesh Pt/ZSM-48 catalyst and the 60-80 mesh Pt/Beta catalyst, respectively. 5 cc of 80-120 mesh sand was also added to both catalyst beds during catalyst loading to fill the void spaces. After pressure testing of the unit, the catalysts were dried and reduced at 400° F. (204° C.) for one hour under 1 atmosphere (atm.), 255 cc/min hydrogen flow. At the end of this period, the flow of pure hydrogen was stopped and flow of $H_2S$ (2% in hydrogen) was initiated at 100 cc/min. After $H_2S$ breakthrough, the reactors 1 and 2 were gradually heated to 700° F. (371° C.) and maintained at 700° F. (371° C.) for 1 h (hour). After the completion of catalyst pre-sulfiding, the gas flow was switched back to pure hydrogen at 255 cc/minute rate, and the two reactors were cooled down.

Hydroisomerization of the C80 Fischer-Tropsch wax over a cascaded Pt/ZSM-48 followed by Pt/Beta was conducted at 1.0 $h^{-1}$ LHSV for each catalyst and 1000 psig (68 atm) with 5500 scf (979 $n.L.L^{-1}$) hydrogen/bbl circulation rate. The wax isomerization experiments were started first by saturating the catalyst beds with the feed at 400° F. (204° C.) then heating the reactors to the initial operating temperatures. Material balances were carried out overnight for 16-24 h. Reactor temperatures were then gradually changed to vary pour point.

Performance of stand-alone Pt/ZSM-48 was evaluated by cooling and bypassing the Pt/Beta catalyst in the second reactor. The experiments were conducted under identical process conditions (1.0 LHSV, 1000 psig (68 atm), 5500 scf/bbl (979 $n.L.L^{-1}$) $H_2$) and according to similar procedures used for testing the cascade Pt/ZSM-48 and Pt/Beta combination.

Performance of Pt/Beta followed by Pt/ZSM-48 was evaluated after switching the two reactors, i.e. order of Pt/ZSM-48 and Pt/Beta catalysts. Process conditions and experimental procedures similar to those for testing the cascaded Pt/ZSM-48 and Pt/Beta combination were employed.

Example 5

Product Separation and Analysis. Off-gas samples were analyzed by GC using a 60 m DB-1 (0.25 mm ID) capillary column with FID detection. Total liquid products (TLP's) were weighed and analyzed by simulated distillation (Simdis, such as D2887) using high temperature GC. TLP's were distilled into IBP-330° F. (IBP-166° C.) naphtha, 330-700° F. (166-371° C.) distillate, and 700° F.+(371° C.+) lube fractions. The 700° F.+(371° C.+) lube fractions were again analyzed by Simdis to ensure accuracy of the actual distillation operations. The pour point and cloud point of 700° F.+(371° C.+) lubes were measured by D97 and D2500 methods, and their viscosities were determined at both 40° C. and 100° C. according to D445-3 and D445-5 methods, respectively.

What is claimed is:

1. A process for converting a Fischer-Tropsch wax having at least about 95% n-paraffins to an isoparaffinic lube basestock, consisting of:

first, passing the Fischer-Tropsch wax and a hydrogen co-feed over a first catalyst selected from the group consisting of a Beta catalyst consisting of a Zeolite Beta and one or more Group VIII metals, to form an intermediate product; and second, passing the intermediate product over a second catalyst selected from the group consisting of a unidimensional molecular sieve catalyst consisting of a ZSM-48 unidimensional intermediate pore molecular sieve and one or more Group VIII metals;

to form the isoparaffinic lube basestock in a yield which is about 10% higher at a given pour point than that obtained using the unidimensional molecular sieve alone or obtained using the unidimensional molecular sieve catalyst first and the Beta catalyst second.

2. A process according to claim 1, wherein the Beta catalyst is kept at a temperature of 400 to 700° F. (204 to 371° C.);

the unidimensional molecular sieve catalyst is kept at a temperature of 500 to 800° F. (260 to 427° C.);

the wax is passed over the Beta catalyst at a feed liquid hourly space velocity of 0.1 to 10 $h^{-1}$;

the intermediate product is passed over the ZSM-48 unidimensional molecular sieve catalyst at a feed liquid hourly space velocity of 0.1 to 10 $h^{-1}$; and the process further comprises less than about 1,500 psig (102 atm) hydrogen, wherein the hydrogen is circulated at 100 to 10,000 scf/bbl (18 to 1780 $n.L.L^{-1}$).

3. A process according to claim 2, wherein the Beta catalyst is kept at a temperature of 500-600° F. (260 to 316° C.);

the ZSM-48 unidimensional molecular sieve catalyst is kept at a temperature of 600-700° F. (316 to 371° C.);

the wax is passed over the Beta catalyst at a feed liquid hourly space velocity of 0.5 to 2 $h^{-1}$;

the intermediate product is passed over the ZSM-48 unidimensional molecular sieve catalyst at a feed liquid hourly space velocity of 0.5 to 2 $h^{-1}$; and the process further comprises less than about 1,500 psig (102 atm) hydrogen, wherein the hydrogen is circulated at 1,000 to 6,000 scf/bbl (178 to 1068 $n.L.L^{-1}$).

4. A process according to claim 3, wherein the Group VIII metal on said catalysts is at least one member selected from the group consisting of Pt and Pd; and the unidimensional molecular sieve catalyst is ZSM-48 with a Alpha value of 10 to 50.

5. A process according to claim 1, 2, 3 or 4, wherein the Zeolite Beta has an Alpha value less than about 15 prior to loading with the Group VIII metal;

the Zeolite Beta is loaded with about 0.5 wt % to about 1 wt % of the Group VIII metal, based on the total weight of the Zeolite Beta;

the ZSM-48 is loaded with about 0.5 wt % to about 1 wt % of the Group VIII metal, based on the total weight of the ZSM-48; and the Group VIII metal is at least one member selected from the group consisting of Pt and Pd.

6. A process according to claim 5, wherein the Beta catalyst is Pt/Beta; and the Pt/ZSM-48 and the Pt/Beta are in a cascaded two-bed catalyst system comprising a first bed followed by a second bed, wherein the first bed comprises the Pt/Beta catalyst and the second bed comprises the Pt/ZSM-48 catalyst.

7. A process according to claim 6, wherein the temperature of the first bed and the temperature of the second bed are controlled independently; and the intermediate product is cascaded directly to the second bed.

8. The process of claim 1 wherein the isoparaffinic lube base stock has a pour point of −12 to −21° C.

* * * * *